US006357084B1

(12) United States Patent
Haidon

(10) Patent No.: US 6,357,084 B1
(45) Date of Patent: Mar. 19, 2002

(54) CURRENCY SECURING AND CARRYING DEVICE

(76) Inventor: Christopher J. Haidon, 9010 Nesbitt Ferry Rd., Lot 259, Alpharetta, GA (US) 30022

( * ) Notice: Subject to any disclaimer, the term of this patent is extended or adjusted under 35 U.S.C. 154(b) by 0 days.

(21) Appl. No.: 09/397,273

(22) Filed: Sep. 16, 1999

(51) Int. Cl.[7] ..... A44B 21/00; B65D 63/00; A45F 5/04

(52) U.S. Cl. ..... 24/3.12; 24/16 R; 24/17 B; 24/306; 24/442

(58) Field of Search ..... 24/306, 442, 17 B, 24/16 R, 3.12, 543, 563, 336, 30.5 P

(56) References Cited

U.S. PATENT DOCUMENTS

| | | | | | |
|---|---|---|---|---|---|
| 37,949 | A | * | 3/1863 | Buswell | 24/17 B |
| 738,462 | A | * | 9/1903 | Lincoln | 24/17 B |
| 956,534 | A | * | 5/1910 | Lahey | 24/17 B |
| D178,032 | S | | 6/1956 | Wilm | D17/3 |
| 2,892,228 | A | * | 6/1959 | Peterson | 24/17 B |
| 3,279,008 | A | * | 10/1966 | Wallach | 24/306 |
| 3,372,438 | A | | 3/1968 | Rinecker | 24/16 |
| 4,139,133 | A | | 2/1979 | Repka | |
| 4,332,338 | A | * | 6/1982 | Christiansen | 224/222 |
| 4,700,432 | A | * | 10/1987 | Fennell | 24/16 R |
| 4,759,963 | A | | 7/1988 | Uso | |
| 4,874,151 | A | * | 10/1989 | Fritz | 24/306 |
| 4,881,684 | A | | 11/1989 | Chinman | |
| 4,964,508 | A | | 10/1990 | Balsley | |
| 5,075,933 | A | * | 12/1991 | Kemper | 24/442 |
| 5,077,869 | A | * | 1/1992 | Haase | 24/3.12 |
| 5,086,543 | A | * | 2/1992 | Mitchell | 24/16 R |
| 5,121,864 | A | | 6/1992 | Geschwind | |
| 5,215,333 | A | * | 6/1993 | Knight | 24/306 |
| 5,279,019 | A | * | 1/1994 | Knickle | 24/3.12 |
| 5,317,787 | A | * | 6/1994 | Fortsch | 24/30.5 P |
| 5,533,656 | A | | 7/1996 | Bonaldi | |
| 5,920,964 | A | * | 7/1999 | Malzahn | 24/17 B |

* cited by examiner

*Primary Examiner*—Victor N. Sakran
(74) *Attorney, Agent, or Firm*—Technoprop Colton LLC

(57) ABSTRACT

A device for securing and carrying currency, having a strap having a first side, a second side, a first end, a second end, a length, a width and a thickness; a fastening mechanism having a first element and a second element, the first element being located on the second side of the strap proximal to the second end of the strap, and the second element being located on the first side of the strap proximal to the first end of the strap; and a thumb tab secured to the strap at or near the first end of the strap and extending outwardly from the strap in the width direction and normal to the length.

17 Claims, 4 Drawing Sheets

CURRENCY SECURING AND CARRYING DEVICE

TECHNICAL FIELD

The invention relates generally to the field of devices for securing and carrying money and credit cards, specifically to the field of devices for securing and carrying money and credit cards such as money clips, and more specifically to devices for securing and carrying money and credit cards using adjustable strap-like devices.

BACKGROUND OF THE INVENTION

People throughout the world carry a variety of items on their persons. Some of the most important items arguably are paper money, credit cards, driver's licenses and/or identification cards, membership cards, and other bits of paper with important and not so important information. As used in this specification, the term 'currency' will be used to refer to any or all of the above items, either singularly or in any combination.

Devices and manners for carrying currency ranges from the conventional, such as purses and wallets, to the innovational, such as rubber bands and paper clips, and from the mundane, such as envelopes and stuffed in pockets, to the interesting, such as hat brims and hidden money belts. Yet none of these individual devices and manners provides a user with a device for securing and carrying currency that can be used in connection with most of the other devices and manners, that is equally appealing to people of most walks of life, and that can be used in most life situations.

There are many different types of wallets, purses and money clips. Most are not versatile enough for use in more than one or two manners. U.S. Pat. No. Des. 178,032 to Wilm discloses an ornamental design for a money clip that appears to work using magnetism. While relatively ingenious, the '032 device necessarily must be designed to work with and hide the magnets necessary to keep the device closed so as to be able to secure the currency. U.S. Pat. No. 4,139,133 to Repka discloses a money belt that uses a hook and loop fastener to attach to the user's clothing. While creating a more secure, as in safe, place to keep currency, the '133 device is bulky and cannot be easily placed in the user's pocket or purse.

Smaller currency securing and carrying devices have been proposed. Most are not small enough to minimize bulging in the user's clothing. U.S. Pat. No. 5,121,864 to Geschwind discloses a pickpocket foiling pouch that has a width greater than the mouth of the pants pocket, preventing easy removal from the pocket. While useful in preventing theft, the '864 device does not allow ease of use or of access to the user's currency. U.S. Pat. No. 5,533,656 to Bona di discloses a combination wallet with removable clip allowing the wallet to be secured to the user's clothing. While useful for preventing the loss of the wallet, the '656 device still is a wallet having all of the material of a wallet and creating typical wallet bulk.

Other devices have been developed for carrying personal effects. Most are mono-functional or do not allow the securing and carrying of currency. U.S. Pat. No. 4,964,508 to Balsley discloses a key cache that also can hold other small devices and uses a hook and loop fastening mechanism. While useful for carrying keys and other small item such as coins, the '508 device cannot easily secure and carry currency and lacks the simplicity necessary for use in a variety of situations. U.S. Pat. No. 4,881,684 to Chinman discloses a wrapper for article with improved securing arrangement that essentially envelopes an article and is itself secured using a hook and loop fastening mechanism. While possibly an alternative for a briefcase, the '684 device is not a pocket- or purse-sized device.

Various devices have been invented for securing items using hook and loop fastening mechanisms. Most, however, are not useful for securing and carrying currency with a minimum of bulk. U.S. Pat. No. 3,372,438 to Rinecker discloses a peel resistant tape assembly that helps prevent the unwanted opening of device secured closed with a hook and loop fastening mechanism. While possibly useful as an add-on to the present invention, the '438 device does not in and of itself lend itself to securing and carrying currency. U.S. Pat. No. 4,759,963 to Uso discloses a fishing pole fastening device that is a strap attachable to both the fishing pole and a fence railing using a hook and loop fastening mechanism. While an acceptable securing device, the '963 device also does not lend itself to securing and carrying currency.

Thus it can be seen that an alternative device for securing and carrying currency is needed that overcomes the limitations of the prior art. The currency securing and carrying device disclosed herein is a new and improved device for securing and carrying currency that overcomes the limitations of the prior art and provides a simple and useful device for carrying out its intended purpose.

BRIEF SUMMARY OF THE INVENTION

The invention is a new and improved device for securing and carrying currency, including paper money, credit cards and the like. The device comprises a thin, flat and preferably elastic strap comprising two ends, a fastening mechanism, and preferably a thumb tab. The strap is wrapped around the user's currency and fastened using the fastening mechanism to secure the currency into one compact pile.

The device in its preferred embodiment comprises a strap, a fastening means and a thumb tab, and is used to secure currency, such as credit cards and paper money. The currency secured by the device can be carried in the hand or placed in a pocket or purse. The strap is a strip of thin, flat flexible material having a length, a width and a thickness. The strap can be made of any known materials, so long as the selected material has sufficient strength and durability secure and carry currency, and to provide a base for the other elements of the device, including the fastening means, the thumb tab, and optional elements such as friction grips and a pull tab. Further, the strap preferably is flexible enough to be wrapped without undue force about currency. Suitable materials include but are not limited to rubbers, plastics, nylons, cloths and other textiles, leather and other skins, strings and cords, metals typically in the form of strands or chains, and combinations of two or more of these materials.

In use, the strap is wrapped around currency. In the preferred embodiment, the strap is elastic such that the strap can be stretched around the currency, thus holding the currency more tightly than inelastic straps. In the alternate embodiment, the strap is not elastic, and is merely wrapped around the currency. The thumb tab is located on one end of the strap and the user holds the thumb tab down against the currency. This allows the device to be held securely against the currency as the strap is wrapped around the currency. One element of the fastening mechanism, such as the loop element of a hook and loop fastening mechanism or the female element of a typical snap fastening mechanism, is located on the strap end immediately proximal to the thumb tab. The second element of the fastening mechanism, such as the hook element of a hook and loop fastening mechanism or the male element of a typical snap fastening mechanism, is located on the strap distal from the thumb tab. Once the strap is wrapped around the currency, the two elements of the fastening mechanism are able to cooperate with each other and secure the device around the currency. Once the fastening mechanism is secured, the device securely holds the various items of currency together and can be carried by the user, either in the had, in the pocket, in the purse, or in many other manners.

An object of the present invention is to provide a device for securing and carrying currency that is small, lightweight, and of low bulk such that it is easily carried by the user without much effort and without causing unnecessary bulging in the user's clothing.

Another object of the present invention is to provide a device for securing and carrying currency that is of such a small size and is obscure enough to appeal to a wide range of people.

Another object of the present invention is to provide a device for securing and carrying currency that is of sufficient strength to securely hold and carry currency so as to prevent both the loss of the currency and the separation of the items of currency from one another.

Another object of the present invention is to provide a device for securing and carrying currency that is adjustable so as to be able to secure and carry small, medium and large amounts of currency.

Another object of the present invention is to provide a device for securing and carrying currency that is simple to use, simple and economical to manufacture, and economical to obtain.

These objects, and other objects, features and advantages of the present invention, will become more apparent to those of ordinary skill in the art when the following detailed description of preferred embodiments is read in conjunction with the attached drawing figures in which like reference numerals indicate like parts throughout the several views.

DETAILED DESCRIPTION OF PREFERRED EMBODIMENT

Figure 1:
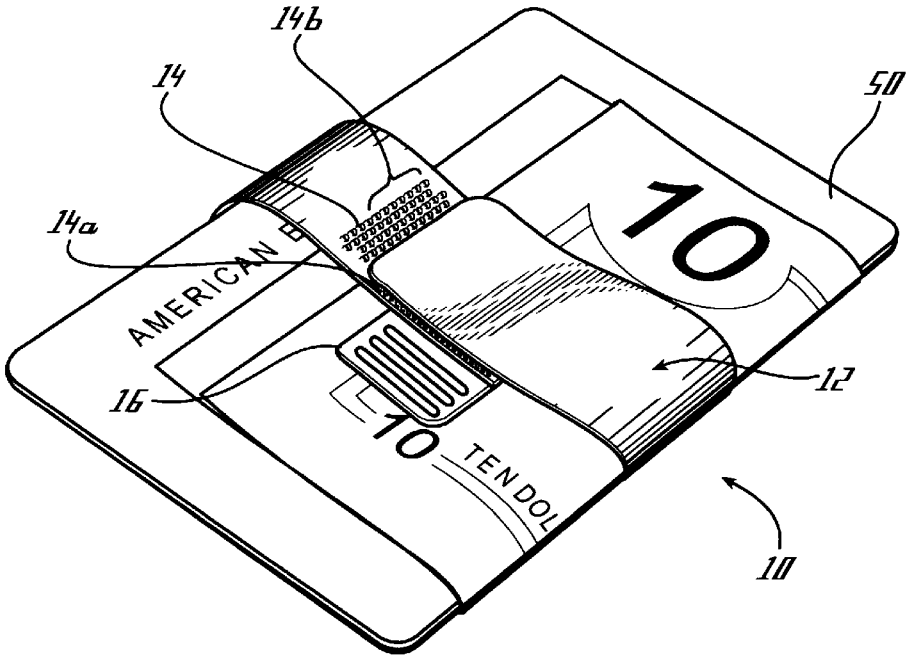
FIG. 1 is a perspective view of the money and card securing and carrying device of the invention.

Referring now to the FIGS., the currency securing and carrying device 10 is shown in an intended manner of use in FIG. 1. The device 10, which in its preferred embodiment comprises strap 12, fastening means 14 and thumb tab 16, is secured about currency 50, such as credit cards and paper money. The currency 50 secured by the device 10 can be carried in the hand or placed in a pocket or purse.

Referring now to FIGS. 2 through 7, the device is shown in more detail. Strap 12 is a strip of thin, flat flexible material having a first side 12*a,* a second side 12*b,* a first end 12*c,* a second end 12*d,* a length L, a width W and a thickness T. Strap 12 can be made of any known materials, so long as the selected material has sufficient strength and durability secure and carry currency, and to provide a base for the other elements of device 10, including fastening means 14, thumb tab 16, and optional elements such as friction grips 18 shown in FIG. 7 and pull tab 22 shown in FIG. 8. Further, strap 12 preferably is flexible enough to be wrapped without undue force by the user about currency 50. Suitable materials include but are not limited to rubbers, plastics, nylons, cloths and other textiles, leather and other skins, strings and cords, metals typically in the form of strands or chains, and combinations of two or more of these materials.

Length L, preferably is greater in dimension than width W and in most embodiments length L is 1.25 to 40.0 times width W. While length L can be of almost any size, it is preferred that length L be between 2 and 4 times the width of the common credit card, more preferably between 2.25 and 3.25 the width of the common credit card, and most preferably between 2.5 and 3.0 the width of the common credit card. The common credit card is defined as having a width of approximately 5.2 cm or 2.125 in. While width W can be of almost any size, it is preferred that width W be no more than the length of the common credit card, more preferably between 0.03 and 0.6 the length of the common credit card, and most preferably between 0.075 and 0.3 the length of the common credit card. The common credit card is defined as having a length of approximately 8.6 cm or 3.375 in. The device 10 can be made of various lengths L and widths W to accommodate both different amounts of currency to be carried and the user's taste in fashion. Thickness T merely needs to be sufficiently thin so as to allow strap 12 to be flexible enough to wrap around currency 50, yet sufficiently thick so as to provide structural strength. One of ordinary skill in the materials arts will be able to determine a suitable thickness T based on the material used.

Fastening mechanism 14 can be any mechanism for fastening two components together in a releasable manner. The preferred fastening mechanisms 14 include hook and loop such as Velcro®, snaps, pressure latches, and buckles. The following description will be in connection with the preferred fastening mechanism 14 of hook and loop, but it will be readily apparent to one of ordinary skill in the art the many other fastening mechanisms 14 can be substituted for the hook and loop and still fall within this disclosure.

Figure 2:
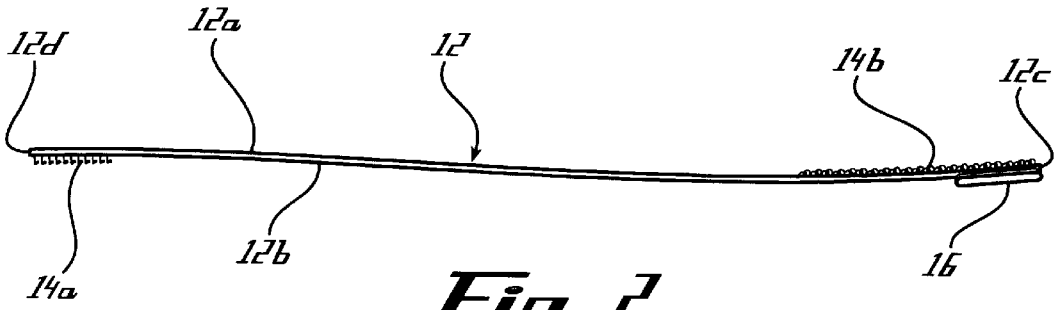
FIG. 2 is a front elevational view of the money and card securing and carrying device shown in FIG 1.
Figure 3:
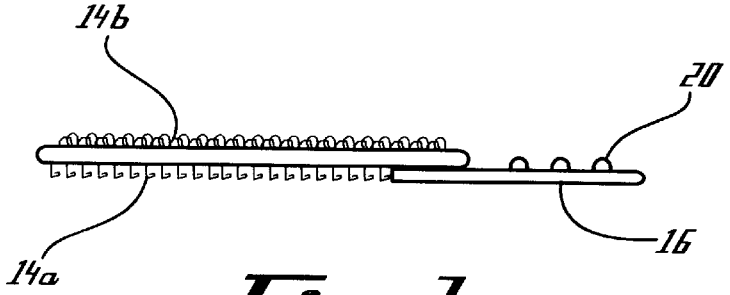
FIG. 3 is a left side elevational view of the money and card securing and carrying device shown in FIG. 1.
Figure 4:
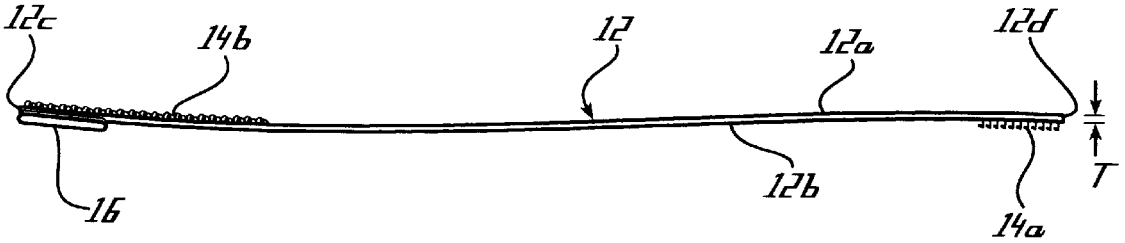
FIG. 4 is a back elevational view of the money and card securing and carrying device shown in FIG. 1.
Figure 5:
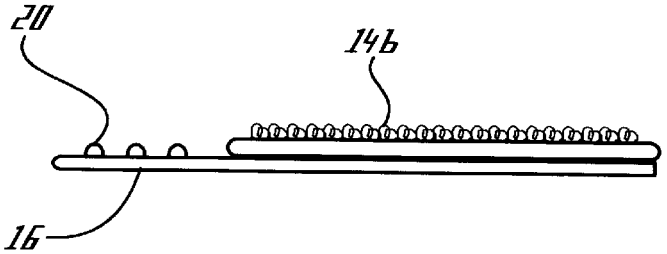
FIG. 5 is a right side elevational view of the money and card securing and carrying device shown in FIG. 1.
Figure 6:
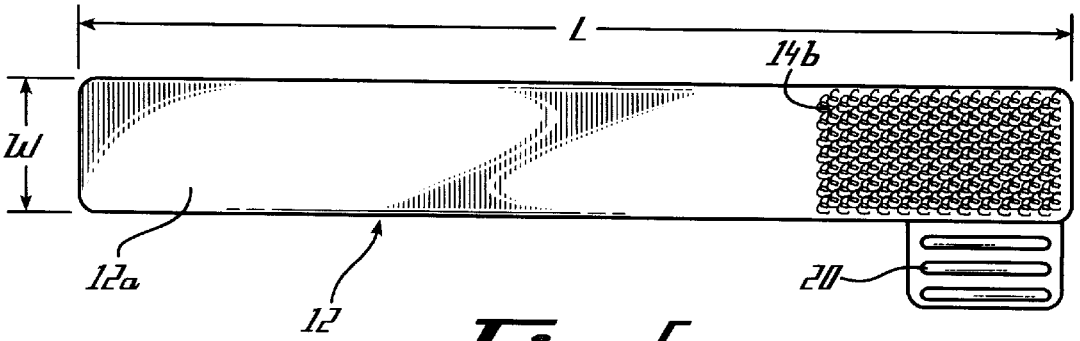
FIG. 6 is a top plan view of the money and card securing and carrying device shown in FIG. 1.
Figure 7:
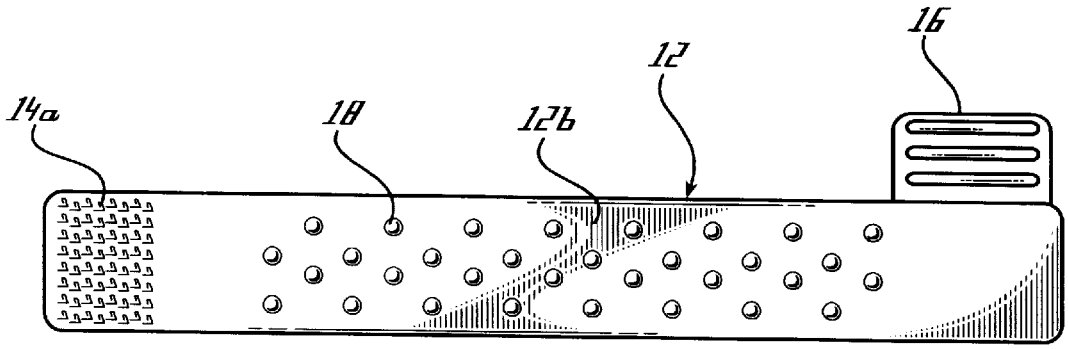
FIG. 7 is a bottom plan view of the money and card securing and carrying device shown in FIG. 1.
Figure 8:
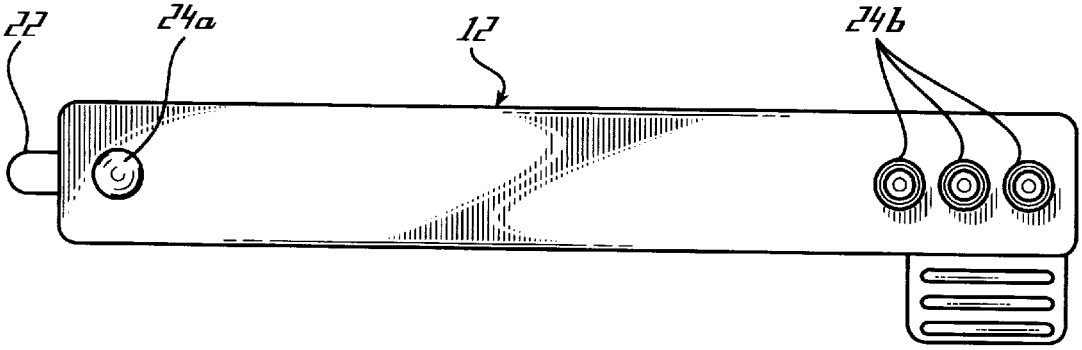
FIG. 8 is a top plan view of the money and card securing and carrying device shown in FIG. 1 showing an alternate embodiment of the fastening mechanism.

One element 14*a* of fastening mechanism 14 is located on second side 12*b* of strap 12 at or near second end 12*d* of strap 12, and a second element 14*b* of fastening mechanism 14 is located on first side 12*a* of strap 12 at or near first end 12*c* of strap 12, as shown in more detail in FIGS. 2, 4 and 8. In this manner, one element 14*a* of fastening mechanism 14, such as hook element or male snap element 24*a,* is located on both the end 12*d* and side 12*b* of strap 12 opposite a second element 14*b* of fastening mechanism 14, such as loop element or female snap element 24*b*. Thus, once device 10 is wrapped around currency 50 as shown in FIG. 1, first end 12*a* of strap 12 and second end 12*b* of strap 12 are proximal to each other, and one element 14*a* of fastening mechanism 14 can cooperate with a second element 14*b* of fastening mechanism 14 to secure device 10 around currency 50

If hook and loop is used, or a fastening mechanism 14 similar to hook and loop, a sufficient amount of fastening mechanism must be located on strap 12. The preferred amount of hook element, or other similar element, as one element 14*a* is a piece approximately one half to the same width as width W and between 0.64 cm or 0.25 in and 3.80 cm or 1.5 in long, more preferably between 0.64 cm or 0.25 in and 2.54 cm or 1.0 in long, and most preferably between 1.27 cm or 0.5 in and 2.54 cm or 1.0 in long. The preferred amount of loop element, or other similar element, as a second element 14*b* is a piece approximately one half to the same width as width W and between 1.27 cm or 0.5 in and the entire length of strap 12 long, more preferably between 1.27 cm or 0.5 in and 5.08 cm or 2.0 in long, and most preferably between 1.27 cm or 0.5 in and 3.80 or 1.5 in long. Alternatively, the entire first side 12*a* of strap 12 can be a second element 14*b* and/or the entire second side 12*b* of strap 12 can be a first element 14*a*.

If a typical snap fastening mechanism is used as fastening mechanism 14, as shown in FIG. 8, one element, such as male element 24*a,* is located at one end and on one side of strap 12, and one or more second elements, such as female elements 24*b,* is located at the opposite end and on the opposite side of strap 12. Preferably, two or more of a second element are used to make the device 10 more adjustable. If a typical buckle fastening mechanism (not shown) or pressure latch (not shown) is used as fastening mechanism 14, the buckle element or latch element preferably is located at first end 12*c* of strap 12, with second end 12*d* of strap 12 being the free end, with holes therethrough if the buckle mechanism, to be inserted through the buckle element or latch element.

Thumb tab 16 is secured to strap 12 at or near first end 12 of strap 12 on second side 12*b* of strap 12. Thumb tab 16 is a piece of material extending outwardly from strap 12 in width W direction, that is normal to length L. Thumb tab 16 allows the user to hold device 10 against currency 50 when securing and unsecuring device 10 around currency 50. Thumb tab 16 can be an extension of the material of strap 12, such that thumb tab 16 and strap 12 are one unitary piece of material, or thumb tab 16 can be a separate piece of the same or a different material than strap 12 securely attached to strap 12.

Figure 9:
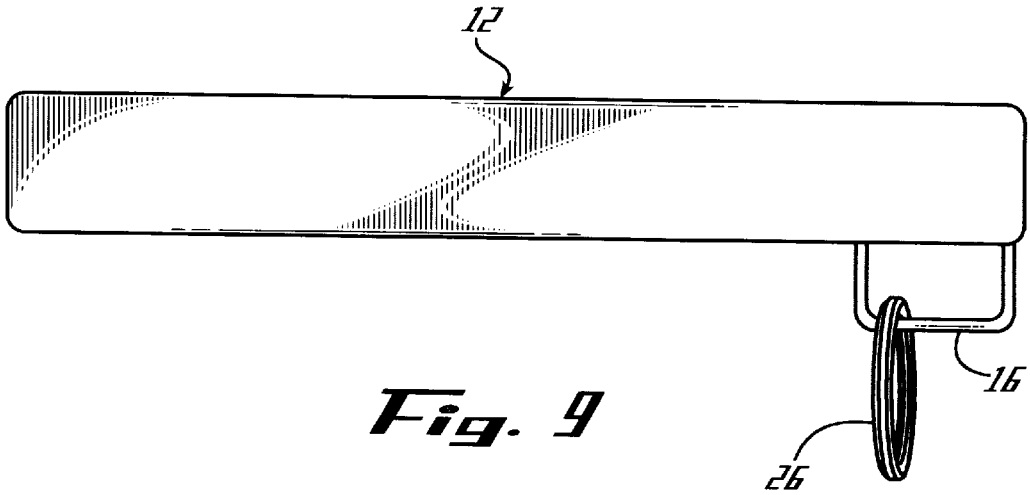
FIG. 9 is a top plan view of the money and card securing and carrying device shown in FIG. 1 showing an alternate embodiment of the thumb tab.

As shown in FIGS. 2 through 8, thumb tab 16 can be a rectangular piece of material attached to strap 12. Optionally, thumb tab 16 can have raised ridges 20 to provide a more secure surface for the user's thumb when holding thumb tab 16 against currency 50. Alternatively, raised ridges 20 can be replaced with raised bumps (not shown) or a high friction material. Preferably, thumb tab 16 is made from a rubber or rubber-like material providing flexibility and friction. As an alternative to a solid piece of material, thumb tab 16 can be of many shapes, such as thumb tab 16 loop shown in FIG. 9. Thumb tab 16 loop provides sufficient surface area for the user's thumb to hold thumb tab 16 against currency 50 and also provides a convenient loop for holding a key ring 26 for example. As such, device 10 becomes both a device for securing and carrying currency 50 and for holding the user's keys or other items.

Figure 10:
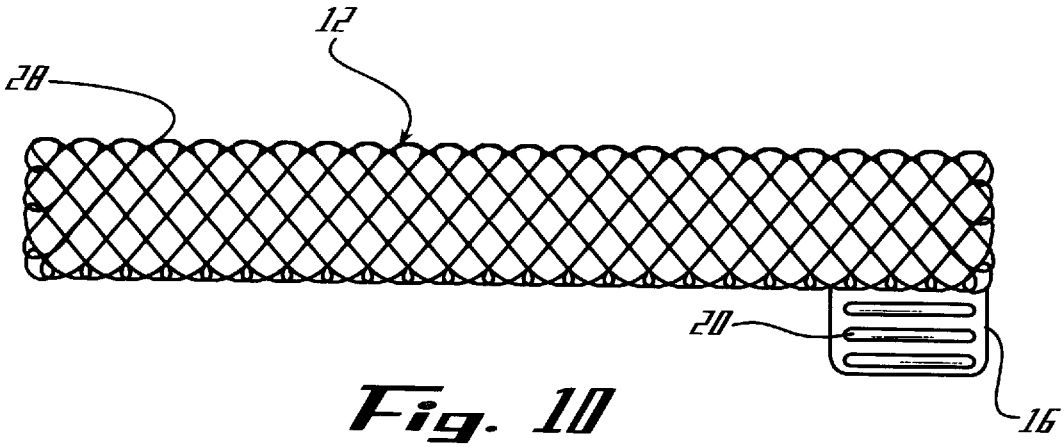
FIG. 10 is a top plan view of the money and card securing and carrying device shown in FIG. 1 showing an alternate embodiment of the strap.

To make device 10 even more convenient and appealing to the user, various options can be included. As shown in FIG. 8, lifting tab 22 can be attached to second end of strap 12. Lifting tab 22 can be used to pull strap 12 tight around currency 50 when securing currency 50, and/or to assist the user in unsecuring device by providing an additional piece of material for the user to grip when pulling second end 12*d* of strap 12 away from first end 12*c* of strap 12 to unfasten fastening mechanism 14. As shown in FIG. 10, strap 12 can be made of braided material 28 much like a common braided leather belt. Other options and alternatives include different materials, different colors and the like to make device 10 both stronger, if necessary, and more aesthetically attractive to the fashion conscious.

Figure 11:
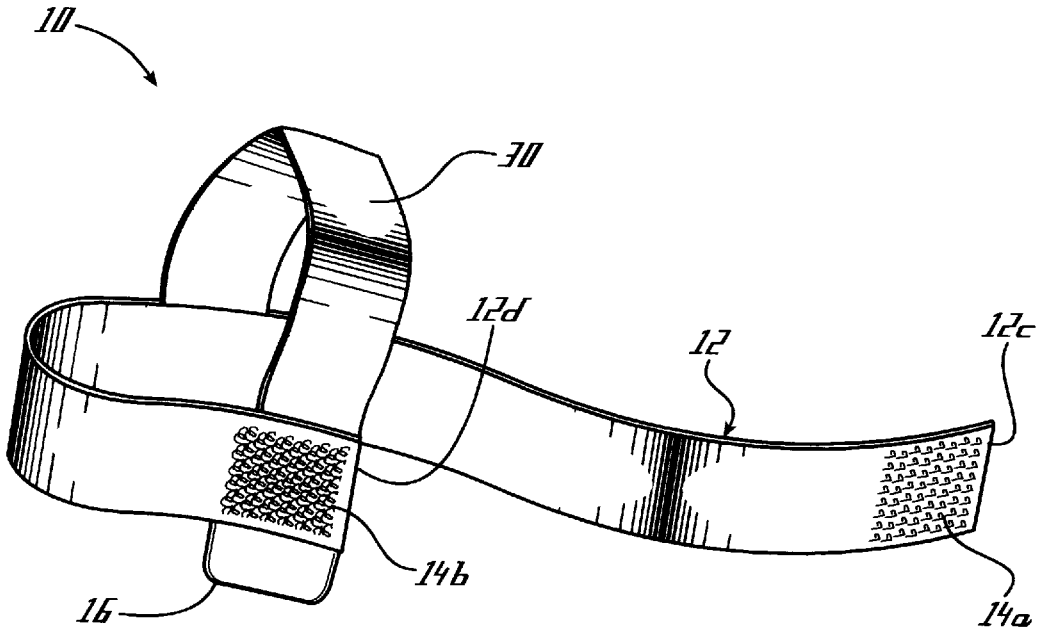
FIG. 11 is a perspective view of an alternate embodiment of the money and card securing and carrying device of the invention.

Referring now to FIG. 11, an alternate embodiment of the device 10 is shown. In this alternate embodiment, brace 30 is secured to strap 12 at two points. Brace 30 comprises a first end and a second end. First end of brace 30 is secured proximal to first end 12*c* of strap 12 and thumb tab 16. Second end of brace 30 is secured along the length of strap 12 at a predetermined point between first end 12*c* and second end 12*d* of strap 12. Brace 30 acts in combination with strap 12 to create a pocket like structure for receiving currency 50 and more securely holds currency within device 10.

In structure, thumb tab 16 can be an extension of strap 12 rather than a separate piece. Alternatively, if brace 30 is included, thumb tab 16 can be an extension of brace 30 rather than a separate piece or an extension of strap 12.

In use, strap 12 is wrapped around currency 50. In the preferred embodiment, strap 12 is elastic such that strap 12 can be stretched around currency 50, thus holding currency 50 more tightly than inelastic straps. In the alternate embodiment, strap 12 is not elastic, and is merely wrapped around currency 50. Thumb tab 16 is located at the first end 12*c* of strap 12 and the user holds thumb tab 16 down against currency 50. This allows device 10 to be held securely against currency 50 as strap 12 is wrapped around currency 50. One element 14*b* of fastening mechanism 14, such as the loop element of a hook and loop fastening mechanism or the female element of a typical snap fastening mechanism, is located on first side 12*a* of strap 12 at or near first end 12*c* of strap 12 immediately proximal to thumb tab 16. Second element 14*a* of fastening mechanism 14, such as the hook element of a hook and loop fastening mechanism or the male element of a typical snap fastening mechanism, is located on second side 12*b* of strap 12 at or near second end 12*d* of strap 12 distal from thumb tab 16. Once strap 12 is wrapped around currency 50, the two elements 14*a,* 14*b* of fastening mechanism 14 are able to cooperate with each other and secure device 10 around currency 50. Once fastening mechanism 14 is secured, device 10 securely holds the various items of currency 50 together and can be carried by the user, either in the hand, in the pocket, in the purse, or in many other manners. If brace 30 is included, currency 50 is placed in the pocket made by strap 12 and brace 30, and then strap 12 is pulled about currency 50 and fastening mechanism 14 is engaged.

To unfasten device 10 from around currency 50, the user grips second end 12*d* of strap 12, or lifting tab 22 if present, and pulls second end 12*d* of strap 12 away from first end 12*c* of strap 12. This motion pulls one element 14*a* of fastening mechanism 14 away from a second element 14*b* of fastening mechanism 14, thus releasing device 10 from currency 50.

The device 10 allows for a safer and more convenient way to secure and carry money, credit cards, and other currency. It is compact and has a low profile and can be used in a wide variety of situations to organize, secure and carry currency in an easy to use and assemble package. The device 10 eliminates the need to carry a bulky wallet or a multiplicity of other money holder devices. The above description of preferred embodiments and attached figures are for illustrative purposes only and are not intended to limit the spirit and scope of the invention as defined by the appended claims.

What is claimed is:

1. A device for securing and carrying currency, comprising:

a. a strap having a first side, a second side, a first end, a second end, a length, a width and a thickness;

b. a fastening mechanism having a first element and a second element, the first element being located on the second side of the strap proximal to the second end of the strap, and the second element being located on the first side of the strap proximal to the first end of the strap; and c. a brace having a first end and a second end, wherein the first end of the brace is secured to the first end of the strap and the second end of the brace is secured along the length of the strap.

2. The device characterized in claim 1, wherein the strap is a strip of thin, flat flexible material.

3. The device characterized in claim 2, wherein the strap is constructed of at least one material selected from the group consisting of rubbers, plastics, nylons, textiles, skins, strings, cords, metals strands, and metal chains.

4. The device characterized in claim 1, wherein the length of the strap is greater in dimension than the width of the strap.

5. The device characterized in claim 4, wherein the length of the strap is 1.25 to 40.0 times the width of the strap.

6. The device characterized in claim 5, wherein the length of the strap is between 2 and 4 times the width of the common credit card and the width of the strap is at most the length of the common credit card.

7. The device characterized in claim 6, wherein the length of the strap is between 2.25 and 3.25 the width of the common credit card and the width of the strap is between 0.03 and 0.6 the length of the common credit card.

8. The device characterized in claim 7, wherein the length of the strap is between 2.5 and 3.0 the width of the common credit card and the width of the strap is between 0.075 and 0.3 the length of the common credit card.

9. The device characterized in claim 1, wherein the fastening mechanism is selected from the group of fastening mechanisms that can fasten two components together in a releasable manner.

10. The device characterized in claim 9, wherein the fastening mechanism is selected from the group consisting of hook and loop, snaps, pressure latches, and buckles.

11. The device characterized in claim 10, wherein the fastening mechanism is hook and loop, with the first element of fastening mechanism being hook and the second element of fastening mechanism being loop, and with the amount of hook element being a piece of hook element between one half to the same width as the width and between 0.64 cm or 0.25 in and 3.80 cm or 1.5 in long, and with the amount of loop element being a piece of loop element between one half to the same width as the width and between 1.27 cm or 0.5 in and the entire length of strap long.

12. The device characterized in claim 9, wherein the first element of the fastening mechanism cooperates with the second element of the fastening mechanism to secure the device around the currency.

13. The device characterized in claim 1, further comprising a thumb tab secured to the strap proximal to the first end of the strap.

14. The device characterized in claim 13, wherein the thumb tab extends outwardly from the strap in the width direction and normal to the length.

15. The device characterized in claim 14, wherein thumb tab further comprises a friction increasing mechanism selected from the group consisting of raised ridges, raised bumps, and high friction materials.

16. The device characterized in claim 1, further comprising a lifting tab proximal to the second end of the strap.

17. A device for securing and carrying currency, comprising:

a. a strap having a first side, a second side, a first end, a second end, a length, a width and a thickness, wherein the length of the strap is between 2 and 4 times the width of the common credit card and the width of the strap is no more than the length of the common credit card;

b. a fastening mechanism having a first element and a second element, the first element being located on the second side of the strap proximal to the second end of the strap, and the second element being located on the first side of the strap proximal to the first end of the strap, wherein the fastening mechanism is selected from the group of fastening mechanisms that can fasten two components together in a releasable manner and the first element of the fastening mechanism cooperates with the second element of the fastening mechanism to secure the device around the currency;

c. a thumb tab secured to the strap at or near the first end of the strap a brace having a first end and a second end, wherein the first end of the brace is secured to the first end of the strap and the second end of the brace is secured along the length of the strap, wherein the thumb tab extends outwardly from the strap in the width direction and normal to the length; and d. a brace having a first end and a second end, wherein the first end of the brace is secured to the first end of the strap and the second end of the brace is secured along the length of the strap.

* * * * *